US011492085B2

(12) United States Patent
Liu et al.

(10) Patent No.: US 11,492,085 B2
(45) Date of Patent: Nov. 8, 2022

(54) DEVICE CARRYING PLATFORM BASED ON UNDERWATER ROBOT

(71) Applicants: Guangzhou University, Guangzhou (CN); Dongguan Binhaiwan Bay Area Engineering Construction Center, Dongguan (CN); Zhongkai University of Agriculture Engineering, Guangzhou (CN)

(72) Inventors: Airong Liu, Guangzhou (CN); Xuesong Li, Guangzhou (CN); Zhicheng Yang, Guangzhou (CN); Jiyang Fu, Guangzhou (CN); Bingcong Chen, Guangzhou (CN); Lixue Zhu, Guangzhou (CN)

(73) Assignee: ZHONGKAI UNIVERSITY OF AGRICULTURE ENGINEERING, Guangzhou (CN)

( * ) Notice: Subject to any disclaimer, the term of this patent is extended or adjusted under 35 U.S.C. 154(b) by 0 days.

(21) Appl. No.: 17/584,670

(22) Filed: Jan. 26, 2022

(65) Prior Publication Data

US 2022/0234704 A1 Jul. 28, 2022

(30) Foreign Application Priority Data

Jan. 27, 2021 (CN) ..... 202110114193.3

(51) Int. Cl.
*B63C 11/52* (2006.01)
*B63G 8/00* (2006.01)

(52) U.S. Cl.
CPC ..... *B63C 11/52* (2013.01); *B63G 8/001* (2013.01); *B63G 2008/002* (2013.01)

(58) Field of Classification Search
CPC ..... B63C 11/00; B63C 11/52; B63G 8/00; B63G 8/001; B63G 2008/002
See application file for complete search history.

(56) References Cited

U.S. PATENT DOCUMENTS 8,220,408 B2 * 7/2012 Stone ..... B63C 11/42 114/312
11,201,991 B1 * 12/2021 Liu ..... B63C 11/52

OTHER PUBLICATIONS

CN 202110114193.3—Notification of Granting Patent Right to the Invention, dated Jan. 6, 2022, 3 pages, (with English translation).

* cited by examiner

*Primary Examiner* — Lars A Olson
(74) *Attorney, Agent, or Firm* — Getech Law LLC; Jun Ye

(57) ABSTRACT

The present invention discloses a device carrying platform based on an underwater robot. The device carrying platform comprises a mounting rack and more than two mounting seats. The mounting rack comprises a mounting plate and more than two mounting columns fixed to the bottom of the mounting plate, the mounting plate is provided with a plurality of mounting holes, the mounting plate is hinged with a protective screen, the protective screen is provided with an opening, and the opening is hinged with a screen door. The plurality of mounting seats arranged on the mounting rack can be used for mounting devices and instruments of various models, and a first butting part and a second butting part in a mounting groove are matched with each other, so that devices and instruments needed to be mounted are fixed.

7 Claims, 2 Drawing Sheets

DEVICE CARRYING PLATFORM BASED ON UNDERWATER ROBOT

TECHNICAL FIELD

The present invention relates to the field of underwater robots, in particular to a device carrying platform based on an underwater robot.

BACKGROUND

When underwater detection is carried out, besides manual diving, an underwater robot is frequently used to detect. The underwater robot has the characteristics of high detection efficiency and low detection cost, so that it gains favor. When the underwater robot is used in underwater detection, as a position on a body is finite in space, more detection apparatuses and devices cannot be carried. Meanwhile, as the detecting purposes are different, the robot further needs to carry different instruments and devices. However, there are no corresponding positions on a conventional underwater robot to accommodate different instruments and devices, so that the underwater robot is lack of certain universality.

SUMMARY

In order to overcome the defect that a single underwater robot in the prior art cannot carry various detection instruments at the same time, the present invention aims to provide a device carrying platform based on an underwater robot, the platform being capable of carrying various different instruments and devices for underwater operation.

In order to achieve the objective, the present invention adopts a technical scheme as follows:

the present invention provides a device carrying platform based on an underwater robot. The device carrying platform includes a mounting rack and more than two mounting seats. The mounting rack includes a mounting plate and more than two mounting columns fixed to the bottom of the mounting plate, the mounting plate is provided with a plurality of mounting holes, the mounting plate is hinged with a protective screen, the protective screen is provided with an opening, and the opening is hinged with a screen door. A side wall of the mounting seat is provided with a rubber ring in a sleeved manner, a hole wall of the mounting hole is provided with a positioning ring, and the rubber ring is matched with the positioning ring. A top of the mounting seat is provided with a rectangular mounting groove, the mounting groove is internally provided with a mounting component, the mounting component comprises a first butting part and a second butting part, each of two opposite groove walls of the mounting groove is provided with the first butting part and each of the other two opposite groove walls of the mounting groove is provided with the second butting part, the first butting part includes a spring and a first butting plate, the first butting plate is connected to the groove wall of the mounting groove via the spring, and the second butting part includes a second butting plate, a screw, a twisting plate, a fixing rope and a winch. The second butting plate is arranged in the mounting groove, one end of the screw penetrates through the groove wall of the mounting groove and is rotatably connected with the second butting plate, the screw is in threaded fit with the groove wall of the mounting groove, the twisting plate is fixed to the other end of the screw, the twisting plate is provided with a rope guiding channel, the fixing rope is wound around the winch, and two ends of the fixing rope are fixed to the outer wall of the mounting groove.

In a preferred technical scheme of the present invention, an anti-collision ring is fixed to an outer wall of the mounting plate.

In a preferred technical scheme of the present invention, rubber gaskets are fixed to the first butting plate and the second butting plate.

In a preferred technical scheme of the present invention, the device carrying platform based on the underwater robot further includes an emergent upward floating module, the emergent upward floating module including an air box, an air tank, a valve and a rubber ball, wherein the air box is fixed to one side of the mounting columns, the air tank is arranged in the air box, the air box is provided with a through hole, the valve is arranged at an output port of the air tank, the rubber ball is connected with an inflating tube, and the inflating tube penetrates through the through hole and is connected with the output port of the air tank.

In a preferred technical scheme of the present invention, the device carrying platform based on the underwater robot further includes a video collecting component, the video collecting component including a rotating seat and an underwater camera. The rotating seat is fixed to the bottom of the mounting plate, and the underwater camera is fixed to a free end of the rotating seat.

In a preferred technical scheme of the present invention, a fill light is further fixed to the rotating seat.

In a preferred technical scheme of the present invention, the device carrying platform based on the underwater robot further includes a marking component, the marking component including a wire roller, a floating block and a connecting rope, wherein the wire roller is rotatably connected to the mounting column, the floating block is bonded to the protective screen, the rubber ball is located at the bottom of the floating block, and one end of the connecting rope is fixedly connected with the floating block and the other end of the connecting rope winds the wire roller.

The present invention has the beneficial effects that according to the device carrying platform based on the underwater robot provided by the present invention, the plurality of mounting seats arranged on the mounting rack can be used for mounting devices and instruments of various models, and a first butting part and a second butting part in a mounting groove are matched with each other, so that devices and instruments needed to be mounted are fixed. The protective screen can prevent various devices of the mounting rack from being damaged by living beings or sundries in water. Various underwater detection devices and instruments can be mounted on the mounting groove. It is also quite convenient to mount the mounting rack on an underwater robot, so that the carrying capacity of the underwater robot is improved.

11—mounting plate; 12—mounting column; 13—mounting hole; 14—positioning ring; 15—anti-collision ring; 2—mounting seat; 21—rubber ring; 22—mounting groove; 231—first butting plate; 232—spring; 241—second butting plate; 242—screw; 243—twisting plate; 244—fixing rope; 245—winch; 246—rope guide channel; 25—rubber gasket; 3—protecting screen; 31—opening; 32—screen door; 41—air box; 42—air tank; 43—inflating pipe; 44—rubber ball; 45—valve; 51—rotating seat; 52—underwater camera; 53—fill light; 61—line roller; 62—connecting rope; 63—floating block.

DETAILED DESCRIPTION

The technical scheme of the present invention is further described through specific embodiments in combination with the drawings.

Figure 1:
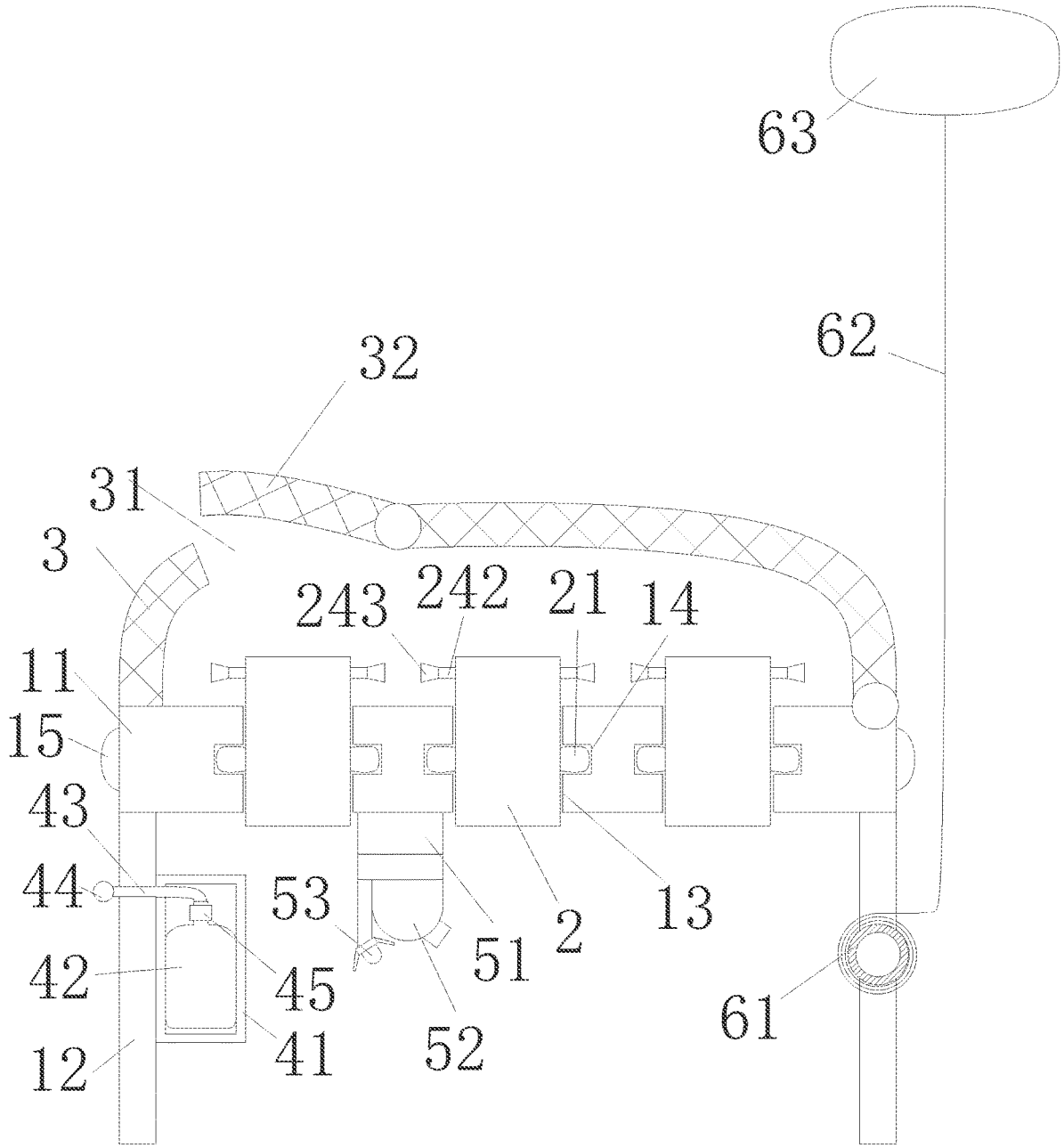
FIG. 1 is a structure diagram of a device carrying platform based on an underwater robot provided by a specific implementation mode of the present invention.
Figure 2:
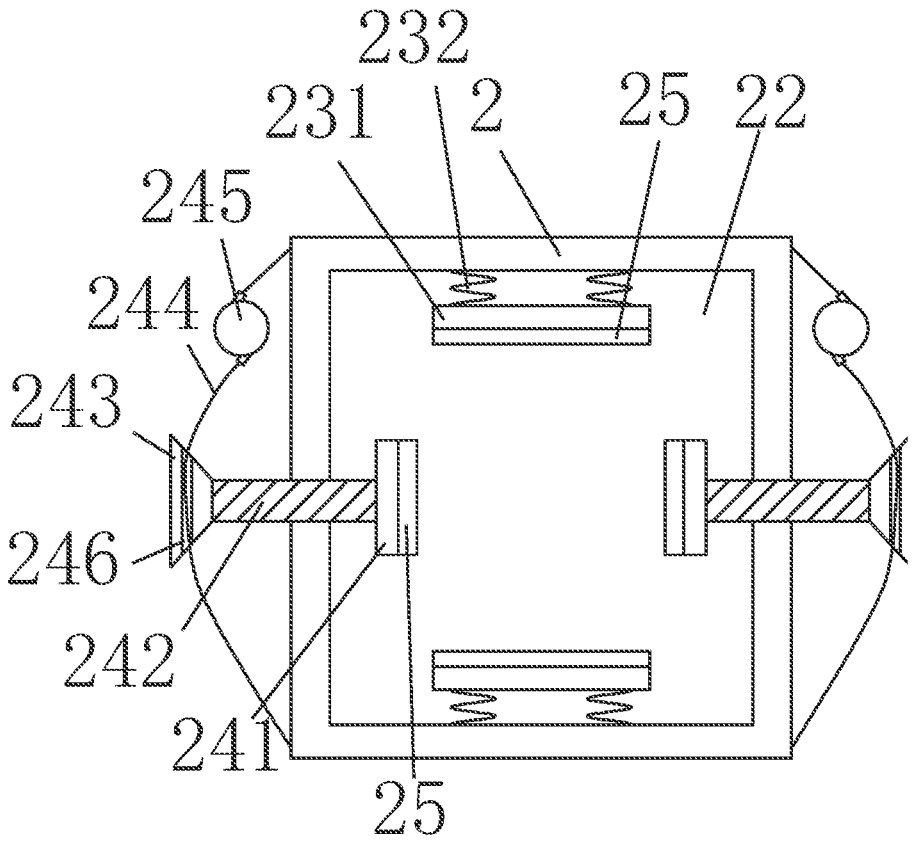
FIG. 2 is a section view structural schematic diagram of a mounting groove in FIG. 1.

As shown in FIG. 1 to FIG. 2, the embodiment provides a device carrying platform based on an underwater robot. The device carrying platform includes a mounting rack and more than two mounting seats 2. The mounting rack includes a mounting plate 11 and more than two mounting columns 12 fixed to the bottom of the mounting plate 11, the mounting plate 11 is provided with a plurality of mounting holes 13, the mounting plate 11 is hinged with a protective screen 3, the protective screen 3 is provided with an opening 31, and the opening 31 is hinged with a screen door 32. A side wall of the mounting seat 2 is provided with a rubber ring 21 in a sleeved manner, a hole wall of the mounting hole 13 is provided with a positioning ring 14, and the rubber ring 21 is matched with the positioning ring 14. A top of the mounting seat 2 is provided with a rectangular mounting groove 22, the mounting groove 22 is internally provided with a mounting component, the mounting component comprises a first butting part and a second butting part, each of two opposite groove walls of the mounting groove 22 is provided with the first butting part and each of the other two opposite groove walls of the mounting groove is provided with the second butting part, the first butting part comprises a spring 232 and a first butting plate 231, the first butting plate 231 is connected to the groove wall of the mounting groove 22 via the spring 232, and the second butting part comprises a second butting plate 241, a screw 242, a twisting plate 243, a fixing rope 244 and a winch 245. The second butting plate 241 is arranged in the mounting groove 22, one end of the screw 242 penetrates through the groove wall of the mounting groove 22 and is rotatably connected with the second butting plate 241, the screw 242 is in threaded fit with the groove wall of the mounting groove 22, the twisting plate 243 is fixed to the other end of the screw 242, the twisting plate 243 is provided with a rope guiding channel 246, the fixing rope 244 is wound around the winch 245, and two ends of the fixing rope 244 are fixed to the outer wall of the mounting groove 22.

When the mounting rack is mounted to the underwater robot, it is only necessary to form the connecting hole in the underwater robot and insert the mounting column 12 to the connecting hole to finish installation. Mounting seats 2 with different quantities can be used on the mounting rack according to the quantity of instruments needed to be carried. First, the fixing rope 244 is taken out from the guide channel, and the screw 242 is twisted by the twisting plate 243 to loosen the second butting plate 241. Then the two first butting plates 231 are pressed, the bottom of the instrument is placed in the mounting groove 22, and the two first butting plates 231 are loosened, so that the first butting plates 231 abut against the bottom of the instrument. Then, the twisting plate 243 is rotated to rotate the second butting plate 241, so that the second butting plates 241 on two sides are close to the instrument. Finally, the butting plates 241 on two sides press the bottom of the instrument. At the butting plates 241 press the instrument, the fixing rope 244 penetrates through the guide channel, and two ends of the fixing rope 244 are fixed to the mounting seat 2, and then the winch 245 is twisted to tighten the fixing rope 244. The fixing rope 244 presses the top plate to the direction of the mounting groove 22, so that a bolt is prevented from loosening outwards in the using process. After the instrument is mounted, the mounting seat 2 can be inserted into the mounting hole 13, so that the rubber ring 21 on the mounting seat 2 is clamped into a positioning ring 14 of the drill hole. After installation, the protective screen 3 is closed, and the underwater robot can be put in water to detect. Devices such as a mechanical arm needed to be operated are mounted, so that the device can head out from the opening 31 by opening the screen door 32 on the protective screen 3.

In above-mentioned manner, it is convenient and rapid, so that it is favorable to mount and fit instrument quickly, and the cost of purchasing underwater robots of different models is saved.

Specifically, an anti-collision ring 15 is fixed to an outer wall of the mounting plate 11. The anti-collision ring 15 is made from a rubber material. When the carrying platform collides with an underwater hard object accidentally, collision can be buffered, so that the mounting rack and the instrument on the mounting rack are protected.

Specifically, rubber gaskets 25 are fixed to the first butting plate 231 and the second butting plate 241. The rubber gaskets 25 can prevent the butting plates from clamping the bottom of the device.

Specifically, the device carrying platform based on the underwater robot further includes an emergent upward floating module, the emergent upward floating module including an air box 41, an air tank 42, a valve 45 and a rubber ball 44, wherein the air box 41 is fixed to one side of the mounting columns 12, the air tank 42 is arranged in the air box 41, the air box 41 is provided with a through hole, the valve 45 is arranged at an output port of the air tank 42, the rubber ball 44 is connected with an inflating tube 43, and the inflating tube 43 penetrates through the through hole and is connected with the output port of the air tank 42. Under a condition that a power part fails or is short of electric quantity, the valve 45 is opened. A compressed gas in the air tank 42 is inflated into the rubber ball 44 via the inflating pipe 43, the rubber ball 44 is blown slowly, and the obtained buoyancy force is larger increasingly, and finally, it carries the robot and the mounting rack to float up to the water level.

Specifically, the device carrying platform based on the underwater robot further includes a video collecting component, the video collecting component including a rotating seat 51 and an underwater camera 52. The rotating seat 51 is fixed to the bottom of the mounting plate 11, and the underwater camera 52 is fixed to a free end of the rotating seat 51. An underwater condition can be shot via a camera under the tree, so that it is convenient to conduct research, and meanwhile, the rotating seat 51 can rotate, so that it is convenient to observe different angles.

Specifically, a fill light 53 is further fixed to the rotating seat 51. Under a condition of insufficient underwater light condition, the fill light 53 can improve the underwater height, so that the underwater camera 52 can shoot better pictures.

Specifically, the device carrying platform based on the underwater robot further includes a marking component, the marking component including a wire roller 61, a floating block 63 and a connecting rope 62, wherein the wire roller 61 is rotatably connected to the mounting column 12, the floating block 63 is bonded to the protective screen 3, the rubber ball 44 is located at the bottom of the floating block 63, and one end of the connecting rope 62 is fixedly connected with the floating block 63 and the other end of the connecting rope 62 winds the wire roller 61. After the carrying platform enters the water, the floating block 63 floats to the water level. As the carrying platform sinks, the line roller 61 rotates continuously to release the connecting rope 62. The floating block 63 is made in a bright color, so that it is convenient for water staff to know a rough position of the underwater robot.

The present invention is described via the preferred embodiment. Those skilled in the art know that various changes or equivalent substitutions can be made on the features and embodiments without departing from the spirit and the scope of the present invention. The present invention is not limited by the specific embodiments disclosed herein, and other embodiments falling into the claims of the application shall fall within the protection scope of the present invention.

The invention claimed is:

1. A device carrying platform based on an underwater robot, the device carrying platform comprising a mounting rack and more than two mounting seats, wherein the mounting rack comprises a mounting plate (11) and more than two mounting columns fixed to the bottom of the mounting plate, the mounting plate is provided with a plurality of mounting holes, the mounting plate is hinged with a protective screen, the protective screen is provided with an opening, and the opening is hinged with a screen door;

a side wall of the mounting seat is provided with a rubber ring in a sleeved manner, a hole wall of the mounting hole is provided with a positioning ring, and the rubber ring is matched with the positioning ring;

a top of the mounting seat is provided with a rectangular mounting groove, the mounting groove is internally provided with a mounting component, the mounting component comprises a first butting part and a second butting part, each of two opposite groove walls of the mounting groove is provided with the first butting part and each of the other two opposite groove walls of the mounting groove is provided with the second butting part, the first butting part comprises a spring and a first butting plate, the first butting plate is connected to the groove wall of the mounting groove via the spring, and the second butting part comprises a second butting plate, a screw, a twisting plate, a fixing rope and a winch; and the second butting plate is arranged in the mounting groove, one end of the screw penetrates through the groove wall of the mounting groove and is rotatably connected with the second butting plate, the screw is in threaded fit with the groove wall of the mounting groove, the twisting plate is fixed to the other end of the screw, the twisting plate is provided with a rope guiding channel, the fixing rope is wound around the winch, and two ends of the fixing rope are fixed to the outer wall of the mounting groove.

2. The device carrying platform based on an underwater robot according to claim 1, wherein an anti-collision ring is fixed to an outer wall of the mounting plate.

3. The device carrying platform based on an underwater robot according to claim 1, wherein rubber gaskets are fixed to the first butting plate and the second butting plate.

4. The device carrying platform based on an underwater robot according to claim 1, the device carrying platform further comprising:

an emergent upward floating module, the emergent upward floating module comprising an air box, an air tank, a valve and a rubber ball, wherein the air box is fixed to one side of the mounting columns, the air tank is arranged in the air box, the air box is provided with a through hole, the valve is arranged at an output port of the air tank, the rubber ball is connected with an inflating tube, and the inflating tube penetrates through the through hole and is connected with the output port of the air tank.

5. The device carrying platform based on an underwater robot according to claim 1, the device carrying platform further comprising:

a video collecting component, the video collecting component comprising a rotating seat and an underwater camera, wherein the rotating seat is fixed to the bottom of the mounting plate, and the underwater camera is fixed to a free end of the rotating seat.

6. The device carrying platform based on an underwater robot according to claim 5, wherein a fill light is further fixed to the rotating seat.

7. The device carrying platform based on an underwater robot according to claim 1, the device carrying platform further comprising:

a marking component, the marking component comprising a wire roller, a floating block and a connecting rope, wherein the wire roller is rotatably connected to the mounting column, the floating block is bonded to the protective screen, the rubber ball is located at the bottom of the floating block, and one end of the connecting rope is fixedly connected with the floating block and the other end of the connecting rope winds the wire roller.

* * * * *